US005778987A

United States Patent [19]

Baiden et al.

[11] Patent Number: 5,778,987

[45] Date of Patent: Jul. 14, 1998

[54] GUIDED DRILLING SYSTEM WITH SHOCK ABSORBER

[75] Inventors: Gregory R. Baiden, Lively; Donald D. Young, Sudbury; Lambertus H. Van Berkel, Millgrove; David L. Hoover, Hamilton; Paul DeVlugt, Val Caron, all of Canada

[73] Assignee: Inco Limited, Toronto, Canada

[21] Appl. No.: 639,632

[22] Filed: Apr. 29, 1996

[51] Int. Cl.[6] ..... B25D 17/24; E21B 17/00

[52] U.S. Cl. ..... 173/19; 173/46; 173/81; 173/91; 173/136; 173/184; 173/171; 173/162.1

[58] Field of Search ..... 173/91, 136, 137, 173/210, 211, 212, 171, 184, 73, 80, 206, 207, 46, 19, 81, 114

[56] References Cited

U.S. PATENT DOCUMENTS

| | | | |
|---|---|---|---|
| 842,049 | 1/1907 | Wolski . | |
| 1,112,498 | 10/1914 | Van es . | |
| 1,861,042 | 8/1932 | Zublin . | |
| 2,548,616 | 4/1951 | Priestman et al. | 255/4 |
| 3,306,172 | 2/1967 | Attebo | 91/283 |
| 3,392,792 | 7/1968 | Hunter | 173/211 |
| 4,054,180 | 10/1977 | Bassinger | 173/136 |
| 4,632,191 | 12/1986 | McDonald et al. | 173/91 |
| 4,637,475 | 1/1987 | England et al. | 173/43 |
| 4,681,172 | 7/1987 | Mikiya et al. | 173/139 |
| 4,834,193 | 5/1989 | Leitko, Jr. et al. | 173/91 |
| 5,226,487 | 7/1993 | Spektor | 173/91 |
| 5,327,636 | 7/1994 | Wilson | 173/211 |

*Primary Examiner*—Scott A. Smith
*Attorney, Agent, or Firm*—Edward A. Steen

[57] ABSTRACT

There is provided a guided drilling system and an in-the-hole shock absorber adapted thereto. The guided drilling system includes a drill string configured to continuously and accurately bore a hole in the ground without the need to periodically break the connection of the drill string. In order to protect the components of the drilling system a hollow core shock absorber for percussive drill strings has been designed. A centrally disposed coil spring transmits the necessary thrust to a percussive hammer while providing a resilient cushion for vibration displacement. Pressurized fluid flows through the center of the shock absorber through a poppet valve.

30 Claims, 4 Drawing Sheets

11
11
A
B
12
14
16
32
34
36
38
40
42
44
46
48
50
54
56
58
60
66
68
70
72
74
76
78
84
86
88
90
92
94

14
32
54
82

44
60
62
64
80

GUIDED DRILLING SYSTEM WITH SHOCK ABSORBER

TECHNICAL FIELD

The instant invention relates to mining in general and, more particularly, to a guided drilling system having a down hole shock absorber distinct from a percussive hammer in a drill string.

BACKGROUND ART

Percussive hard rock hammers utilize an air driven reciprocating mass to cause a bit to continuously impact the drill face. The drill is repeatedly rotated to provide a new face to the drill bit. The resultant crushed and broken rock is swept from the working surface and flushed out of the hole by the same air used to operate the hammer. The violent hammering action causes debilitating vibration that can damage uphole equipment.

With the advent of remotely guided drilling rigs, the in-hole guidance electronics and hydraulics need to be especially protected from the vibrations engendered by the hammer.

Presently, applicants are aware of a down hole shock absorber utilizing a rubber donut. This design is unsatisfactory since the rubber soon fails due to the excessive heat energy dissipated by the drilling operation. An alternative design includes a large diameter shock absorber that will not fit in typical hard rock bore hole diameters of six to ten inches (15.2–25.4 cm). There are long length shock absorbers that are unacceptable for guided systems.

For the aforesaid reasons, most hard rock shock absorbers must be installed above the holes. This defeats the entire purpose of a continuously fed guided drill string. Instead of continuously feeding the drill string into the hole as it inexorably extends into the rock, the drilling operation must be stopped, the string broken, segments and components added and reconnected and the string then repressurized. The constant stop and start drilling action causes delays, additional expenses and exposes personnel to potential physical danger.

SUMMARY OF THE INVENTION

Accordingly, there is provided a guided drilling system with an in-hole shock absorber for percussive drills. A coil spring transmits the necessary forward thrust to the hammer while providing a resilient cushion for vibration displacement. Torque is transmitted through the shock absorber using low friction splines. Operative air is centrally routed through the shock absorber to the hammer. The hammer is continuously fed into the bore hole without the need to break the string while simultaneously being guided and steered in the desired direction with minimum deviation. The instant design results in a relatively short shock absorber.

PREFERRED MODE FOR CARRYING OUT THE INVENTION

Long-hole production methods are used extensively in the underground mining industry to increase ore recovery rates and to reduce development costs. Effective implementation of these methods relies on the accurate drilling of blastholes over distances ranging from 200–400 feet (61–122 m). However, conventional hardrock drilling equipment has no means of directional control. As a result, excessive deviation of blastholes from their intended trajectories is a frequent and costly occurrence. Unpredictable and inefficient blasting is caused by the incorrect positioning of explosives. The entire mining process is affected due to dilution and poor fragmentation of the recovered ore.

Currently, in-the-hole ("ITH") drills (see, for example, U.S. Pat. No. 4,637,475) represent the state-of-the-art in long-hole drilling technology. Typical deviations are in the range of 10% of hole length. In some instances, an average 400 foot (122 m) long blasthole may miss its target by 40 feet (12.2 m) in any direction. Consequently, ITH drills are considered inaccurate.

In addition, the drill string must be broken, reconnected and repressurized each time an extension rod works its way into the ground.

Figure 1:
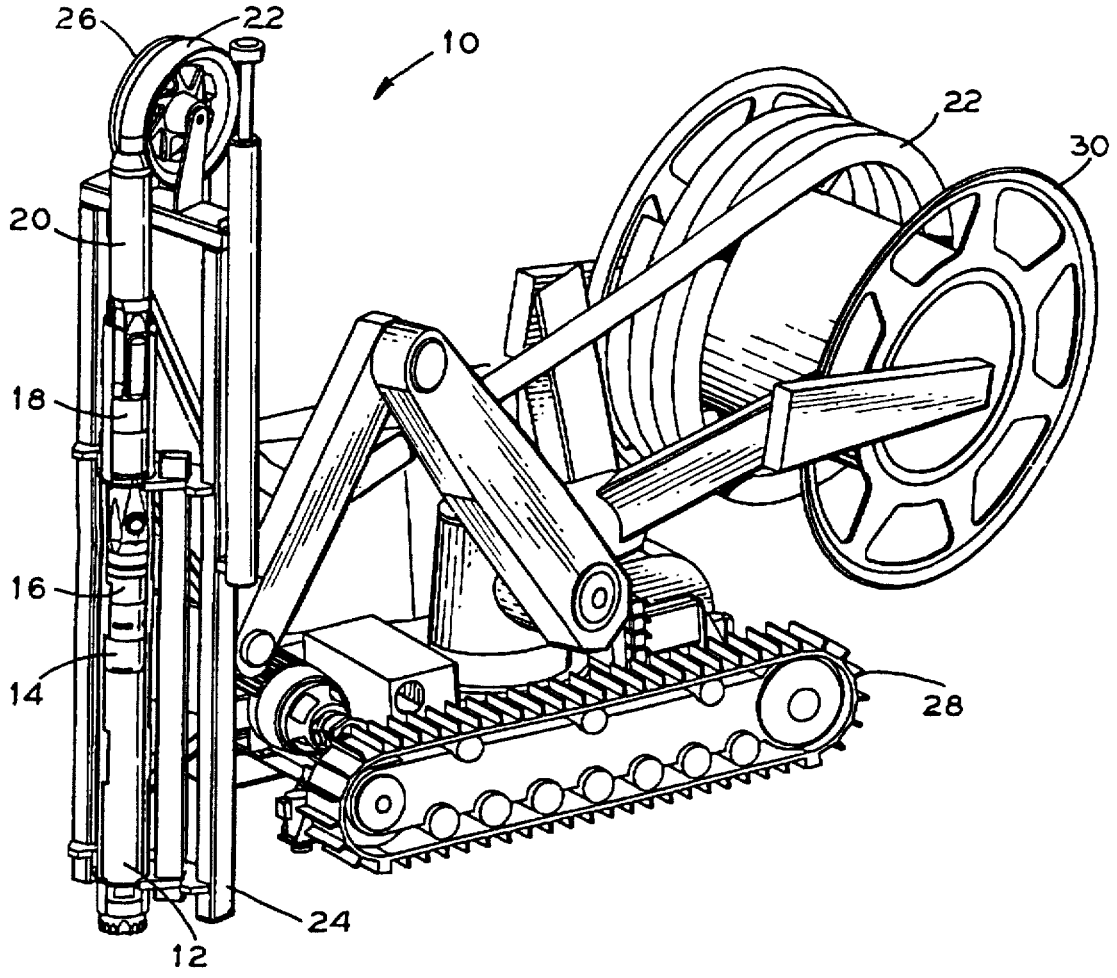
FIG. 1 is a view of an embodiment of the invention.

Accordingly, a continuously fed, guided driller is highly desirable. Such an apparatus is shown in FIG. 1.

A guided drilling system ("GDS") is represented by numeral 10. In brief, the drill 10 includes a rotary percussive hammer 12, a shock absorber 14, a hammer rotator 16, a stabilizer/tractor 18 for advancing and steering the hammer 12, a guidance system 20 and an umbilical conduit 22 supported by a mast 24 and a pulley 26. A self-propelled support platform 28 movably engaging the mast 24 and upholding an umbilical conduit 22 supply reel 30 positions and operates the drill 10 in a continuous manner. Electrical signals and pneumatic and hydraulic fluid are fed into the system 10 via the umbilical conduit 22. A down hole sleeve (not shown for ease of viewing the components of the system 10) circumscribes some of the components of the drill 10.

As opposed to a conventional ITH drill, the GDS drill 10 is able to continuously bore a hole in an accurate manner.

After the platform 28 is positioned, the hammer 12 is energized to drill the hole in the underlying surface. Hydraulic fluid is utilized to continuously cause the rotator 16 to turn so as to rotate the hammer 12. The guidance system 20, including onboard means for continuously determining the position of the hammer 12 including depth, angle of attack, deviation, etc., continuously monitors the state of the drilling operation in real time. By guiding the hammer 12 in the predetermined direction, any deviations may be rapidly corrected by the guidance system 20 allowing the hammer 12 to continuously drill in the correct pattern.

The stabilizer/tractor 18 includes a plurality of wall pads that may be selectively extended or withdrawn as necessary to steer the drill string in the proper direction while simultaneously maintaining stabilizing contact with the bore wall.

The guidance system 20 will direct the stabilizer/tractor 18 to steer the hammer 12 in the intended direction or correct from any deviation. During the drilling cycle, the stabilizer/tractor 18 will anchor the drill string in the hole and simultaneously extend the hammer 12 further into the hole being drilled. After a predetermined drilling distance, the stabilizer/tractor 18 will partially release its grip on the bore wall and then longitudinally propel itself further into the hole by a fixed distance thus repeating the drilling operation in a continuous push-pull fashion; all the while with the guidance system 20 maintaining the drill string in the proper orientation by manipulating the stabilizer/tractor 18 as necessary.

As the stabilizer/tractor 18 forces the hammer further into the hole being drilled in the proper orientation, the umbilical conduit 22 is slowly withdrawn from the reel 30.

The attenuation of the forced vibration caused by the action of the hammer 12 is an important consideration in the development of the guided drill 10. Much of the onboard electronic, pneumatic and hydraulic equipment in the in-the-hole guidance system 20 is sensitive to high levels of impact. Additionally, vibration would adversely affect the ability of the drill 10 to maintain a positive contact between the stabilizer/tractor 18 and the rock wall. The shock absorber 14 has been incorporated into the design to provide a degree of isolation of the hammer 12 from the other components of the drill 10.

The shock absorber 14 must attenuate the transmission of impacting forces originating from the hammer 12 while maintaining the ability to effectively transmit the required torque and thrust.

It was determined that a very low spring constant is required to attenuate the vibration from the hammer 12. This characteristic would create a system with a much lower natural frequency than the vibration frequency and thus minimize the transmission of impact forces. However, it was also noted that a device with a low spring constant would not achieve the required thrust over a reasonable deflection. These conflicting observations led to a design of a shock absorber with a softening spring.

Another important function of the shock absorber 14 is to apply thrust to the hammer 12. The potential energy stored in the spring is used to maintain axial thrust to the hammer 12 while the stabilizer/tractor 18 is operative. This feature makes it possible for the drilling action to be continuous and significantly increases average drilling rates.

Experiments with shock absorber prototypes were undertaken using various spring configurations and splines. The results of these experiments suggested that minimizing axial friction was a fundamental factor in the design of the system since friction (both internal spring friction and friction at the contacting surfaces of the splines) appeared to be the main means of force transmission.

Disk springs were found to be the only ones to offer the desired softening characteristic. However, it was determined that the internal friction (hysteresis) inherent to this type of spring is excessive.

Although not a softening type spring, a large diameter coil spring 32 used in the instant invention was found to offer the lowest transmission of force and currently constitutes the best design alternative.

Figure 2:
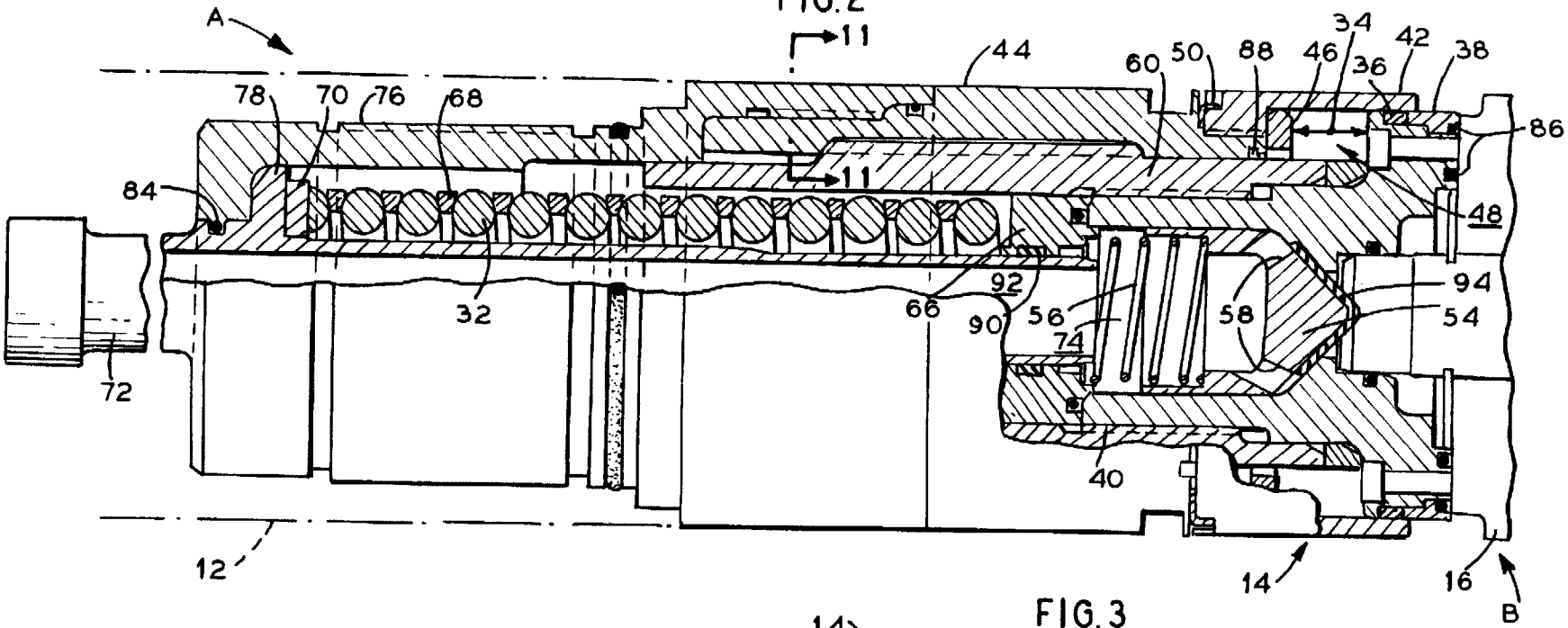
FIG. 2 is a partially cut away cross sectional view of an embodiment of the invention.
Figure 3:
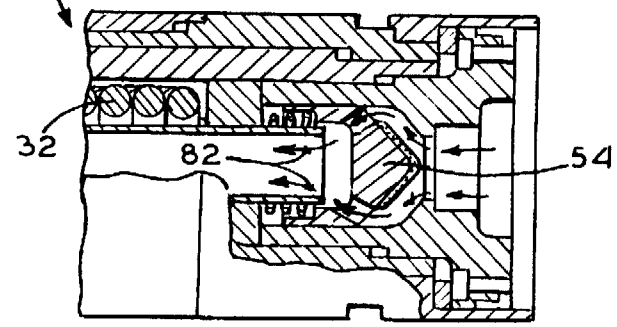
FIG. 3 is a partially cut away cross sectional view of an embodiment of the invention.

FIGS. 2 and 3 are cross-sectional views of the shock absorber 14. In the description below, certain conventional mechanical components Caskets, etc.) are not discussed. It is considered to be within the realm of the art that these components need not be fully elaborated.

As opposed to conventional shock absorber designs, the instant shock absorber 14 is configured to allow pressurized air to flow essentially uninhibited directly through the center of the absorber 14 so as to operate the hammer 12.

The absorber 14 includes a precompressed coil spring 32 preferably having a spring constant of about 2400 lbs/in. ($4.2\times10^5$N/M). Precompression of the spring 32 to about 2500 pounds ($1.1\times10^4$N) is used to reduce the overall length of the assembled absorber 14.

In the embodiment shown, the stroke distance 34 is about 1.25 inches (3.2 cm).

The above-referenced as well as the following physical values are non-limiting prototypical parameters that may be altered to suit changing conditions and experience levels. It is contemplated that the spring chosen for a given application is based on obtaining the full range of desirable hammer thrust over the stroke. Accordingly, the spring would be preloaded to just below the minimum thrust of the operating thrust range.

Figure 10:
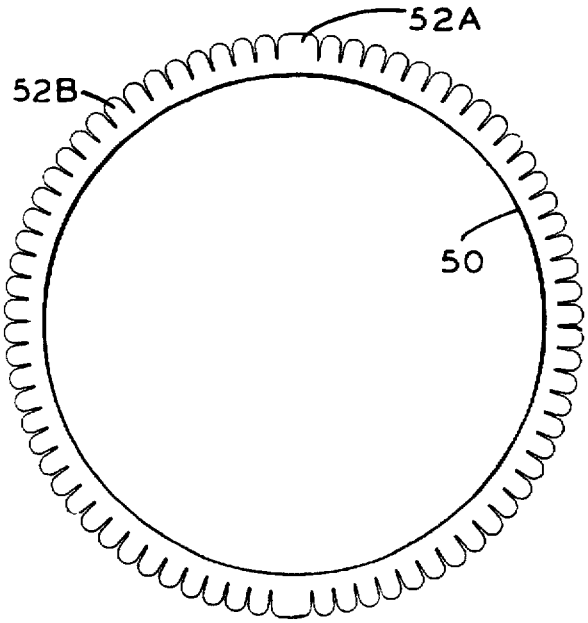
FIG. 10 is a plan view of an embodiment of the invention.
Figure 6:
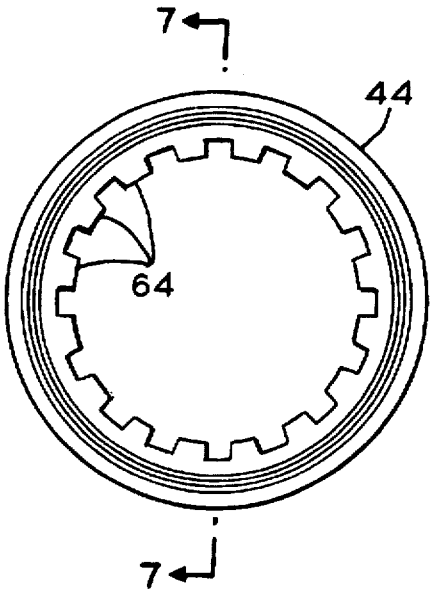
FIG. 6 is a plan view of a component of the invention.
Figure 7:
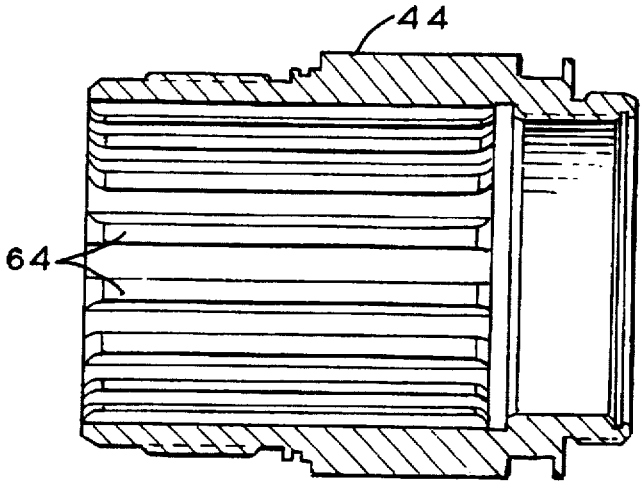
FIG. 7 is a cross sectional view taken along line 7—7 of FIG. 6.

A Variseal™ gasket 36 is dispersed between a wiper retainer 38, an adapter 40 and a sleeve 42. The sleeve 42 is threaded (left-handed) to female spline member 44. See also FIGS. 6 and 7. A resilient annular stop 46 defines the stroke distance 34 in a cavity 48 with the adapter 40. Prior to the coupling between the sleeve 42 and the female spline member 44, a tab washer 50 is inserted therebetween. See also FIG. 10. The extra wide tabs 52A on the tab washer 50 are bent to center the washer 50 on the face of the female spline member 44. Narrow tabs 52B are bent to fit into the sleeve 42. The tabs 52A and 52B are sized and spaced to match mating notches in the sleeve 42 (not shown) to provide a vernier effect allowing the washer 50 and the sleeve 42 to be threaded together to the required torque and then locked into virtually any position. The tab washer 50, acting as a lock washer, serves to resist the unthreading of the sleeve 42 during operation.

Figure 5:
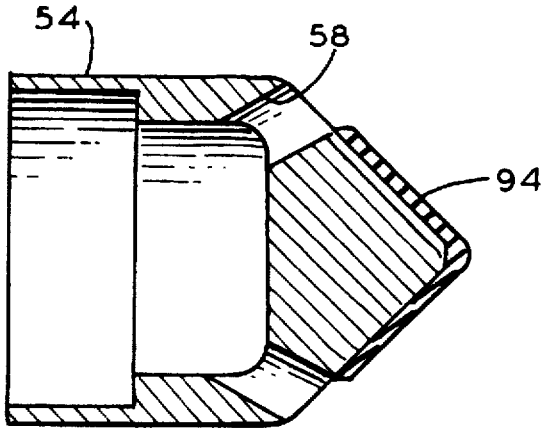
FIG. 5 is a cross sectional view taken along line 5—5 of FIG. 4.
Figure 4:
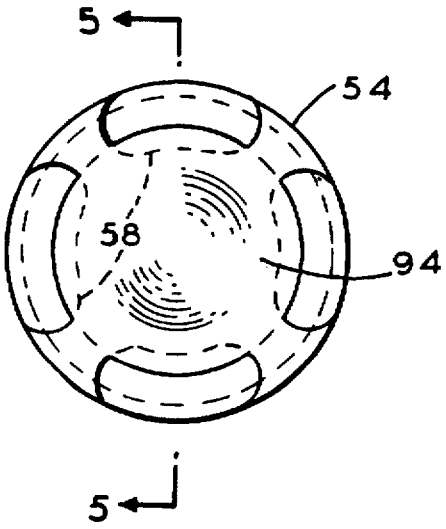
FIG. 4 is a plan view of a component of the invention.

Poppet valve 54, adapted from a Halco™ hammer, slideably engages the adapter 40 in poppet valve cavity 74. See also FIGS. 4 and 5. The valve 54 is biased to be closed via spring 56. The valve 54 includes air channels 58. A seal 94, affixed to the valve 54, engages the adapter 40.

Figure 8:
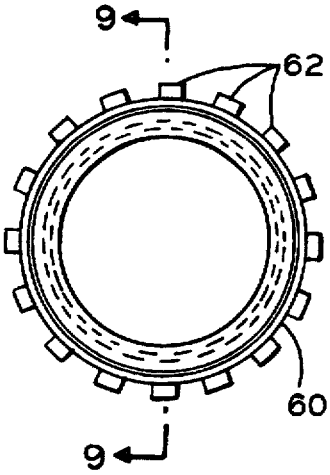
FIG. 8 is a plan view of a component of the invention.
Figure 9:
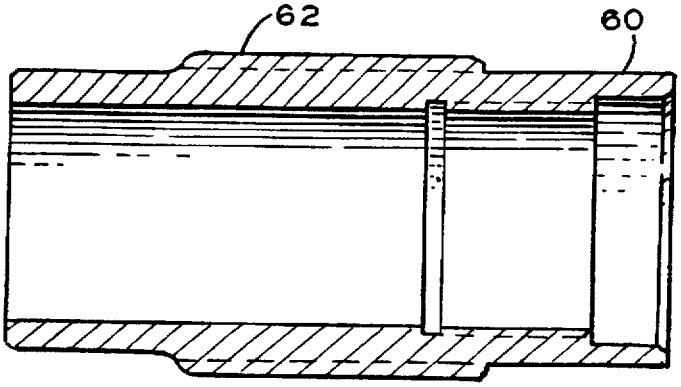
FIG. 9 is a cross sectional view taken along line 9—9 of FIG. 8.

The adapter 40 is threadably engaged to a male spline member 60. See FIGS. 8 and 9. The member 60 includes a plurality of splines 62 that mate with corresponding splines 64 on the female spline member 44. See also FIGS. 6 and 7. These splines, 62 and 64, are all lubricated prior to engagement. The splines 62 and 64 permit longitudinal travel greater than the stroke distance 34.

Figure 11:
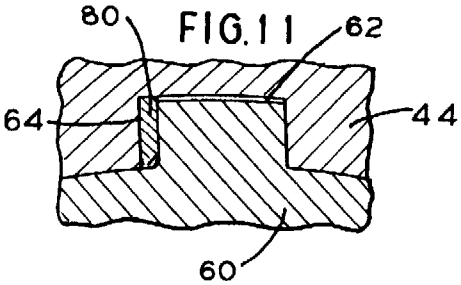
FIG. 11 is a view taken along line 11—11 of FIG. 2.

In order to reduce friction, it is preferred to use SAE square splines 62 and 64 lined with a Vespel™ low friction polymeric liner 80. See FIG. 11 which is taken along lines 11—11 in FIG. 2. The liner 80 is inserted only at one interface of each spline 62–64 pair. This construction was selected because the hammer 12 is rotated one way while drilling. If turned in the opposite direction, the shock absorber 14 may unthread.

After the poppet valve 54 and the spring 56 are inserted into the adapter 40 and the adapter 40 is threadably engaged to the male spline member 60, a dual action gland plate 66 is forced against the adapter 40 to maintain the distal end of the spring 56 in position. The coil spring 32 with an intertwined neoprene open cell spacer 68 (available from Canadian Tire™ and other suppliers) is disposed in the center of the male spline member 60 against the spring stop 66.

A preload spacer 70 having a predetermined thickness to appropriately tension the spring 32 bookends the proximal end of the spring 32.

An air tube 72 having a spring land 78 in contact with the preload spacer 70 is inserted into the spring 32 past the gland plate 66 into a poppet valve cavity 74. A backhead 76 is threaded on to the female spline member 44 for final assembly.

For drilling operations, the shock absorber 14 is threaded into a hammer 12 replacing the standard hammer backhead (not shown) and affixed to the rotator 16.

Pressurized air is directed down through the drill string and into the shock absorber 14. The pressurization is sufficient to overcome the resistance of the spring 56 and force the poppet valve 54 away from the adaptor 40. FIG. 3 shows the shock absorber 14 fully compressed. Note the air tube 72 partially extended into the cavity 74. The air, shown as flow arrows 82, continues to flow through the central core interior of the air tube 72 via the channels 58. The poppet valve 54 is necessary to prevent water and debris from being flushed back into the hammer 12 when the air is shut off. It is a requirement of the hammer 12.

As opposed to conventional shock absorbers the instant shock absorber 14 passes torque and presents an unimpeded central pressurized fluid flow channel 92 through the center of the shock absorber 14. Uninterrupted pressurized fluid (typically air) is permitted to directly and centrally pass through the hollow core of the shock absorber 14 to the hammer 12 when the valve 54 is open.

Although the instant discussion has been primarily directed to pneumatic hammers 12, it should be appreciated that water hammers and oil hammers may be used as well. Although dubbed an "air tube 72" for expediency, it is clear that any motive fluid may flow through the shock absorber on its way toward the hammer regardless of type.

The torque required to rotate the hammer 12 is transmitted through the splines 62 and 64. The splines are designed to be unidirectional, i.e., only the contact face for right hand motion is protected by the anti-friction liner 80. Counter-rotating the shock absorber 14 will unthread the assembly.

As stated above, the spring 32 may be preloaded at assembly to about 2,500 pounds ($1.1\times10^4$N), approximately 60% of the minimum expected thrust (approximately 4,000 pounds [$1.78\times10^4$N]). When operating the hammer 12, a thrust of about 4,000 to about 5,000 pounds ($1.78\times10^4$ to $2.22\times10^4$N), is applied through the drill string. During drilling, the operating thrust unseats the male spline 60 and adapter 40 and, while the thrust is within the optimum thrust range, allows them to float between the pre-load and end stop positions.

The shock absorber 14 resists bending due to drilling side loads with two cylindrical surfaces, one on each side of the splines 62 and 64. The spline teeth provide a third point of resistance to bending.

During operation, the oscillating hammer 12 face causes vibrations. Once frictional resistance to movement is overcome, the amplitude of the force transmitted to the uphole equipment is reduced because the displacement of the hammer 12 deflecting the resilient coil spring 32 results in a lower reaction force.

If a thrust greater than about 5500 pounds ($2.45\times10^4$N) or about 110% of the minimum operations thrust is applied, the rubber stop 46 makes contact. The resilient stop 46 cushions further compression until the shock absorber 14 is completely compressed.

Great attention has been paid to reducing the friction within the shock absorber 14. Frictional resistance to axial movement of the proximal assembly A relative to the distal assembly B is introduced at several contact points (seals 36, 84, 86, wiper ring 88, wear ring 90, and at the splines 62 and 64).

The contact point resistance at each of the seals or wear rings is independent of operation. Low friction seals have been selected in all cases.

Due to the concentric placement of the spring 32 and the splines 62 and 64, a relatively short shock absorber length results. Conventional designs utilize axial juxtaposition which increases length. A prototype of the shock absorber 14 is about 25.3 inches (64.3 cm) long.

The resistance to movement at the spline faces is a function of the contact pressure which is proportional to the torque being transmitted. To reduce this resistance, a low friction material liner 80, Vespel™, has been epoxy bonded to the female splines 64. The contact face of the male splines 62 is ground smooth and slides against the liner 80.

Other moving surfaces are coated with grease or a dry film lubricant as appropriate. Load is only transmitted through these surfaces when the shock absorber is subjected to a side load.

While in accordance with the provisions of the statue, there are illustrated and described herein specific embodiments of the invention, those skilled in the art will understand that changes may be made in the form of the invention covered by the claims and that certain features of the invention may sometimes be used to advantage without a corresponding use of the other features.

The embodiments of the invention in which an exclusive property or privilege is claimed are defined as follows:

1. A guided drilling system comprising a drill including an interconnected hammer, a rotator, a push-pull stabilizer/tractor, an in-the-hole-guidance system, an umbilical line, means for supporting the drilling system in the vicinity of a bore hole, and a shock absorber comprising a core therethrough, a coil spring, the coil spring circumscribing a tube, the tube having proximal and distal ends, the coil spring disposed within a male spline member, the male spline member in slidable engagement with a female spline member, the distal end of the tube communicating with a valve, the valve disposed within an adapter, the adapter engaging the male spline member, and a central fluid flow passage longitudinally disposed throughout the core of the shock absorber.

2. The guided drilling system according to claim 1 including a female spline member circumscribing the male spline member.

3. The guided drilling system according to claim 2 wherein the female spline member includes a plurality of first splines, a low friction liner bonded to the first splines, the male spline member including a plurality of second splines, and the second splines engaging the low friction liner.

4. The guided drilling system according to claim 1 wherein the adapter includes a first cavity and the valve is slidably disposed in the first cavity.

5. The guided drilling system according to claim 1 wherein resilient means are disposed within the first cavity, and the resilient means engaging the valve.

6. The guided drilling system according to claim 1 wherein the valve includes a plurality of channels therethrough.

7. The guided drilling system according to claim 1 wherein a sleeve engages both the female member spline member and the adapter to form a second cavity therebetween.

8. The guided drilling system according to claim 7 wherein a resilient stop is disposed within the second cavity.

9. The guided drilling system according to claim 7 wherein a tab washer is disposed between the female spline member and the sleeve.

10. The guided drilling system according to claim 1 wherein a backhead engages the female spline member to circumscribe the coil spring.

11. The guided drilling system according to claim 1 wherein the tube includes a spring land.

12. The guided drilling system according to claim 1 communicating with a source of pressurized fluid.

13. The guided drilling system according to claim 12 wherein the valve is compressed upon the application of the pressurized fluid source.

14. The guided drilling system according to claim 13 wherein the central fluid flow passage is open from one end of the shock absorber to the other end of the shock absorber.

15. A shock absorber comprising a core therethrough, a coil spring, the coil spring circumscribing a tube, the tube having proximal and distal ends, the coil spring disposed within a male spline member, the male spline member in slidable engagement with a female spline member, the distal end of the tube communicating with a valve, the valve disposed within an adapter, the adapter engaging the male spline member, and a central fluid flow passage longitudinally disposed throughout the core of the shock absorber.

16. The shock absorber according to claim 15 including a female spline member circumscribing the male spline member.

17. The shock absorber according to claim 16 wherein the female spline member includes a plurality of first splines, a lubricating liner bonded to the first splines, the male spline member including a plurality of second splines, and the second splines engaging the lubricating liner.

18. The shock absorber according to claim 15 wherein the adapter includes a first cavity and the valve is slidably disposed in the first cavity.

19. The shock absorber according to claim 18 wherein resilient means are disposed within the first cavity, and the resilient means engaging the valve.

20. The shock absorber according to claim 15 wherein the valve includes a plurality of channels therethrough.

21. The shock absorber according to claim 15 wherein a sleeve engages both the female member spline and the adapter to form a second cavity therebetween.

22. The shock absorber according to claim 21 wherein a resilient stop is disposed within the second cavity.

23. The shock absorber according to claim 21 wherein a tab washer is disposed between the female spline member and the sleeve.

24. The shock absorber according to claim 15 wherein a backhead engages the female spline member to circumscribe the coil spring.

25. The shock absorber according to claim 15 wherein the tube includes a spring land.

26. The shock absorber according to claim 15 connected to a percussive hammer.

27. The shock absorber according to claim 15 communicating with a source of pressurized fluid.

28. The shock absorber according to claim 27 wherein the valve is compressed upon the application of the pressurized fluid source.

29. The shock absorber according to claim 28 wherein the central fluid flow passage is open from one end of the shock absorber to the other end of the shock absorber.

30. The shock absorber according to claim 15 including means for affixing the shock absorber to drilling components.

* * * * *